US005103640A

United States Patent [19]

Nada et al.

[11] Patent Number: 5,103,640

[45] Date of Patent: Apr. 14, 1992

[54] AIR-FUEL RATIO FEEDBACK CONTROL SYSTEM HAVING A SINGLE AIR-FUEL RATIO SENSOR DOWNSTREAM OF A THREE-WAY CATALYST CONVERTER

[75] Inventors: Mitsuhiro Nada, Susono; Hiroshi Sawada, Gotenba, both of Japan

[73] Assignee: Toyota Jidosha Kabushiki Kaisha, Toyota, Japan

[21] Appl. No.: 718,022

[22] Filed: Jun. 20, 1991

[30] Foreign Application Priority Data

Jul. 4, 1990 [JP] Japan ..... 2-175416

[51] Int. Cl.[5] ..... F02D 41/14

[52] U.S. Cl. ..... 60/274; 60/276; 60/277; 60/285

[58] Field of Search ..... 60/274, 276, 277, 285

[56] References Cited

U.S. PATENT DOCUMENTS 4,177,787 12/1979 Hattori et al. .
4,364,227 12/1982 Yoshida et al. ..... 60/276
5,052,177 10/1991 Nada ..... 60/274
5,070,692 12/1991 Nada ..... 60/274
5,070,693 12/1991 Nada ..... 60/274

FOREIGN PATENT DOCUMENTS 58-48745 3/1983 Japan .
64-53042 3/1989 Japan .
0230935 9/1990 Japan ..... 123/489

*Primary Examiner*—Ira S. Lazarus
*Assistant Examiner*—L. Heyman
*Attorney, Agent, or Firm*—Kenyon & Kenyon

[57] ABSTRACT

In an air-fuel ratio feedback control system including a single air-fuel ratio sensor downstream of a three-way catalyst converter, the coarse-adjusting term is calculated in accordance with the air-fuel ratio sensor disposed downstream of the catalyst converter, and the gradual change of the coarse-adjusting term is inhibited when the $O_2$ storage effect is reduced and the duty ratio of the inverting cycle is shorter than a predetermined value.

16 Claims, 10 Drawing Sheets

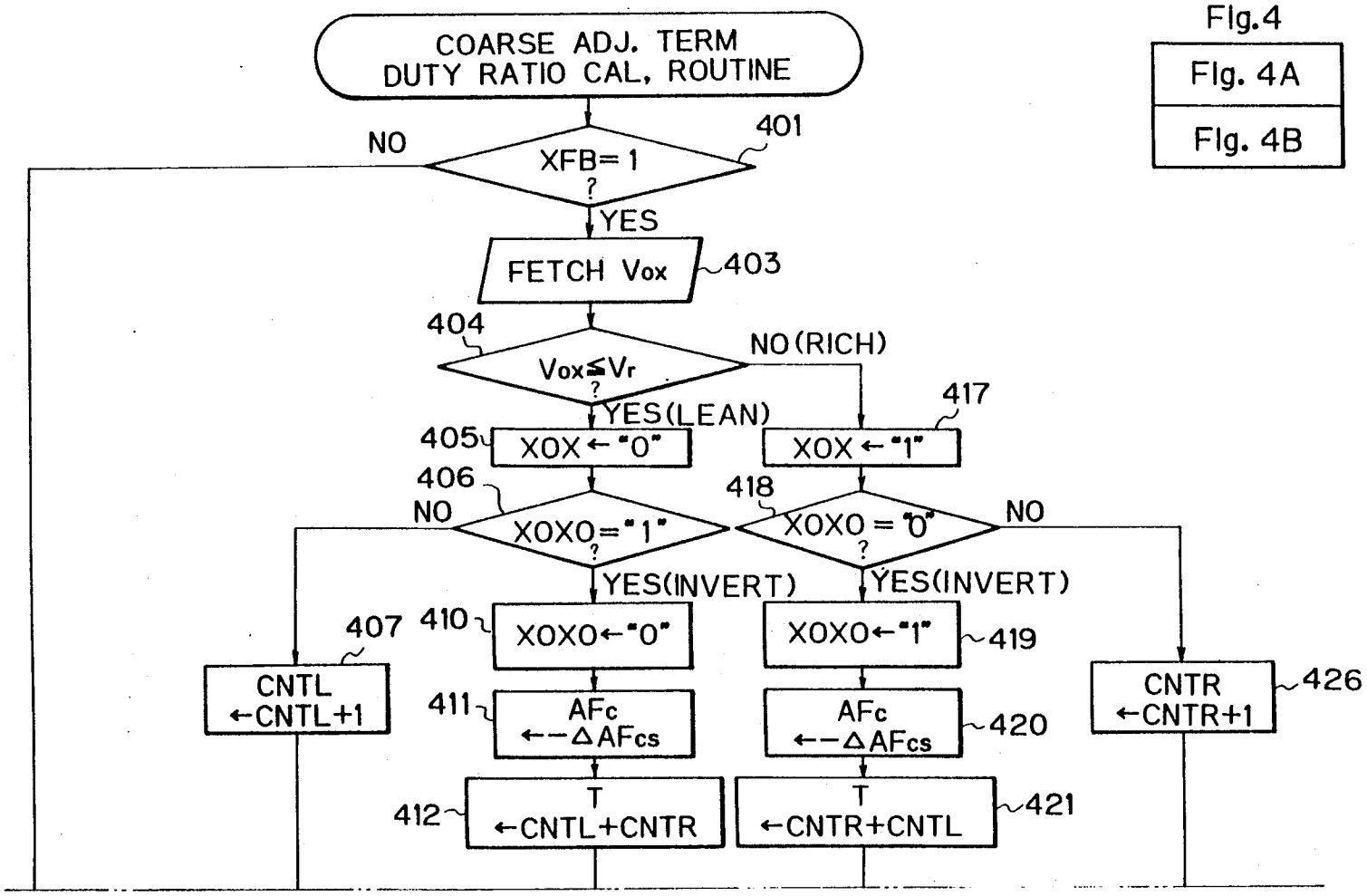
Flg. 4A

AIR-FUEL RATIO FEEDBACK CONTROL SYSTEM HAVING A SINGLE AIR-FUEL RATIO SENSOR DOWNSTREAM OF A THREE-WAY CATALYST CONVERTER

BACKGROUND OF THE INVENTION

1. Field of the Invention

The present invention relates to an air-fuel ratio feedback control system in an internal combustion engine having a single air-fuel ratio sensor downstream of a three-way reducing and oxidizing catalyst converter in an exhaust gas passage.

2. Description of the Related Art

Among known air-fuel ratio feedback control systems using air-fuel ratio sensors ($O_2$ sensors), there exists a single air-fuel ratio sensor system, i.e., having only one air-fuel ratio sensor. Note, in this system the air-fuel ratio sensor is disposed either upstream or downstream of the catalyst converter.

In a single air-fuel ratio sensor system having an air-fuel ratio sensor upstream of the catalyst converter, the air-fuel ratio sensor is disposed in the exhaust gas passage near to a combustion chamber, i.e., near the concentration portion of an exhaust manifold. In this system, however, the output characteristics of the air-fuel ratio sensor are directly affected by a non-uniformity or non-equilibrium state of the exhaust gas. For example, when the air-fuel ratio actually indicates a rich state, but oxygen is still present, the output characteristics of the air-fuel ratio sensor fluctuate. Also, in an internal combustion engine having a plurality of cylinders, the output characteristics of the air-fuel ratio sensor are also directly affected by differences in individual cylinders, and accordingly, it is impossible to detect the mean air-fuel ratio for the entire engine, and thus the accuracy of the control of the air-fuel ratio is low.

On the other hand, in a single air-fuel ratio sensor system having an air-fuel ratio sensor downstream of the catalyst converter, the non-uniformity or non-equilibrium state of the detected exhaust gas has little or no effect, and thus the mean air-fuel ratio for the engine can be detected. In this system, however, due to the capacity of the catalyst converter, the response characteristics of the air-fuel ratio sensor are lowered, and as a result, the efficiency of the catalyst converter cannot be properly exhibited, and thus the HC, CO and $NO_x$ emissions are increased.

To solve the above problems, the following method, for example, is known. Namely, the actual air-fuel ratio is adjusted by a self-oscillating term, and the mean value thereof, i.e., a coarse-adjusting term, is controlled in accordance with the output of the air-fuel ratio sensor disposed downstream of the catalyst converter.

Nevertheless, this method cannot eliminate the increase of HC, CO and $NO_x$ emissions, because a convergence error in the stoichiometric air-fuel ratio occurs due to a phase-difference between the input and the output of the exhaust gas, caused by a low response of the air-fuel ratio sensor.

To solve the above problem, the present inventors have suggested a method of avoiding an overcompensation, which inhibits the gradual change of the coarse-changing term when the time for which the output of the air-fuel ratio sensor is inverted becomes shorter than a predetermined time, because this state can be shown as the actual air-fuel ratio converges on the stoichiometric ratio (see Japanese Unexamined Patent Application (Kokai) No. 2-230934 published on Sept. 13, 1990).

This method, however, cannot avoid a large deviation of the coarse-adjusting term from the stoichiometric ratio when the performance of the catalyst converter, i.e., the $O_2$ storage effect, is weakened. In this state, HC, CO and $NO_x$ in the exhaust gas cannot be absorbed by the catalyst converter, large fluctuations of the measurement of the exhaust gas by the air-fuel ratio sensor disposed downstream of the catalyst converter occur, in the same way as when the air-fuel ratio sensor is disposed upstream of the catalyst converter. As a result, the time for which the output of the air-fuel ratio sensor is inverted becomes shorter, whereby the gradual change of the coarse-adjusting term is inhibited.

SUMMARY OF THE INVENTION

Therefore, an object of the present invention is to provide a air-fuel ratio control system able to maintain the air-fuel ratio at the stoichiometric air-fuel ratio even when the catalyst converter is deteriorated, i.e., when the $O_2$ storage effect of the catalyst converter is reduced.

According to this invention, in an air-fuel ratio feedback control system including a single air-fuel ratio sensor disposed downstream of a three-way catalyst converter, a coarse-adjusting term AFc is calculated integrally and proportionally in accordance with the output of the air-fuel ratio sensor.

Namely, since the integral calculation is inhibited if the time for which the output of air-fuel ratio sensor is inverted becomes shorter than a predetermined time, when the performance of the catalyst converter is weakened, the deviation of the actual air-fuel ratio from the stoichiometric air-fuel ratio can be reduced.

BRIEF DESCRIPTION OF THE DRAWINGS

The present invention will be more clearly understood from the description set forth below with reference to the accompanying drawings.

DESCRIPTION OF THE PREFERRED EMBODIMENTS

Figure 1:
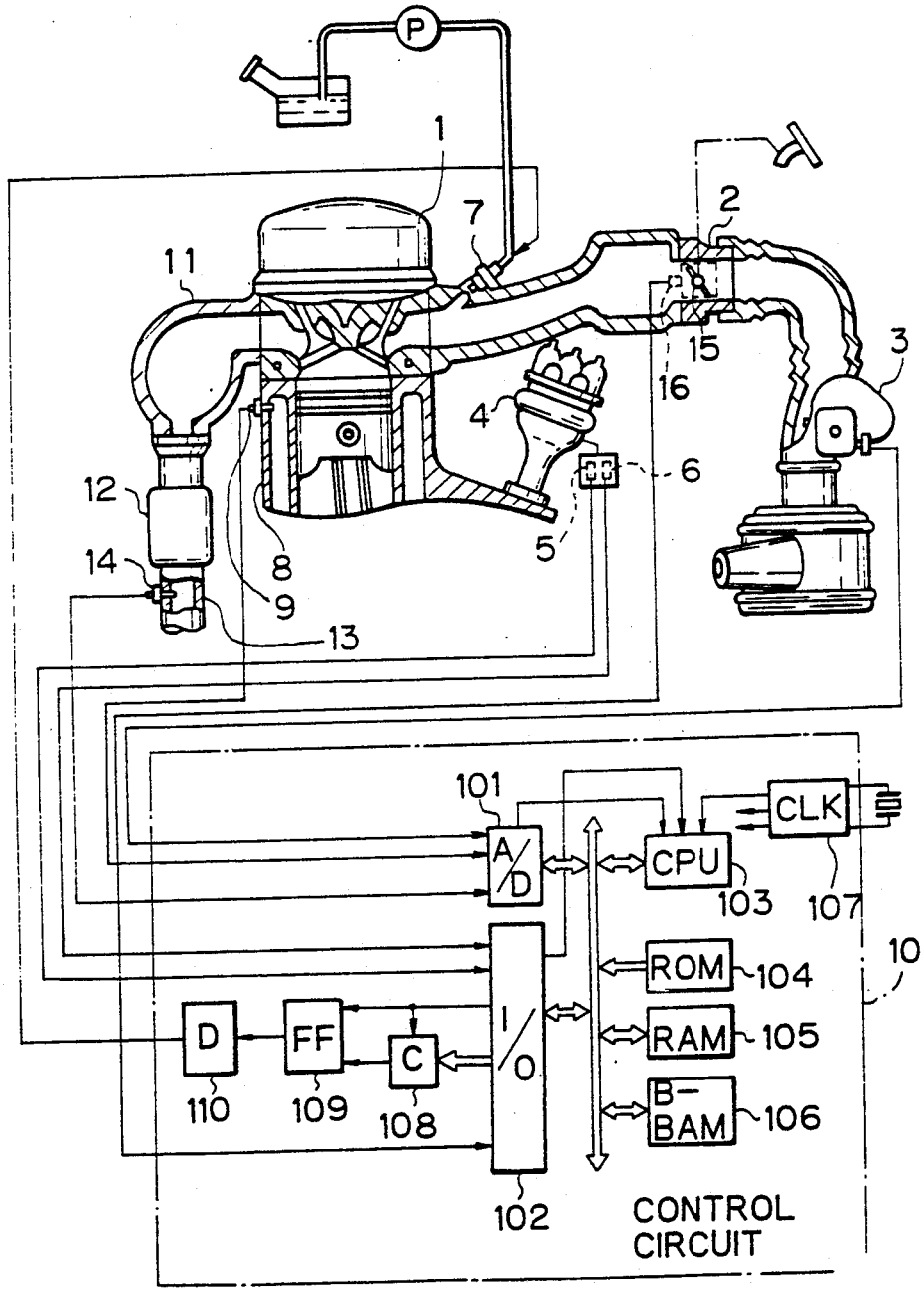
FIG. 1 is a schematic view of an internal combustion engine according to the present invention.

In FIG. 1, which illustrates an internal combustion engine according to the present invention, reference numeral 1 designates a four-cycle spark ignition engine disposed in an automotive vehicle, wherein an air-intake passage 2 of the engine 1 is provided with a potentiometer-type airflow meter 3 for detecting an amount of air drawn into the engine 1, and generating an analog voltage signal proportional to the amount of air flowing therethrough. The signal from the air-flow meter 3 is transmitted to a multiplexer-incorporating analog-to-digital (A/D) converter 101 of the control circuit 10.

Crank angle sensors 5 and 6, for detecting the angle of the crank-shaft (not shown) of the engine 1 are disposed at a distributor 4.

In this case, the crank angle sensor 5 generates a pulse signal at every 720° crank angle (CA) and the crank-angle sensor 6 generates a pulse signal at every 30° CA. The pulse signals from the crank angle sensors 5 and 6 are supplied to an input/output (I/O) interface 102 of the control circuit 10. Further, the pulse signal from the crank angle sensor 6 is then supplied to an interruption terminal of a central processing unit (CPU) 103.

Also provided in the air-intake passage 2 is a fuel injection valve 7 for supplying pressurized fuel from the fuel system to the air-intake port of the cylinder of the engine 1. Note, other fuel injection valves are provided for other cylinders, but these are not shown in FIG. 1.

A coolant temperature sensor 9 for detecting the temperature of the coolant is disposed in a cylinder block 8 of the engine 1. The coolant temperature sensor 9 generates an analog voltage signal in response to the temperature THW of the coolant, and transmits this signal to the A/D converter 101 of the control circuit 10.

A three-way reducing and oxidizing catalyst converter 12, which simultaneously removes three pollutants, CO, HC and NOx from the exhaust gas is provided in an exhaust system on the downstream-side of an exhaust manifold 11.

A air-fuel ratio sensor 14 for detecting the concentration of oxygen composition in the exhaust gas is provided in an exhaust pipe 13 downstream of the catalyst converter 12. This air-fuel ratio sensor 14 generates an output voltage signal and transmits this signal to A/D converter 101 of the control circuit 10.

Reference 15 designates a throttle valve, and 16 designates a throttle sensor which incorporates an idle switch for detecting a time at which the throttle valve 15 is fully closed. The output LL of the idle switch is supplied to the I/O interface 102 of the control circuit.

The control circuit 10, which may be constructed by a microcomputer, further comprises a central processing unit (CPU) 103, a read only memory (ROM) 104 for storing a main routine and interrupt routines such as a fuel injection routine, an ignition timing routine and constants, etc., a random access memory 105 (RAM) for storing temporary data, a backup RAM 106, a clock generator 107 for generating various clock signals, a down counter 108, a flip-flop 109, and a drive circuit 110 and the like.

Note, that a battery (not shown) is connected directly to the backup RAM 106, and therefore, the content thereof is not erased even when the ignition switch (not shown) is turned off.

The down counter 108, flip-flop 109, and drive circuit 110 are used for controlling the fuel injection valve 7. Namely, when a fuel injection amount TAU is calculated in a TAU routine, as explained later, the amount TAU is preset in the down counter 108, and simultaneously, the flip-flop 109 is set and as a result, the drive circuit 110 initiates the activation of the fuel injection valve 7. On the other hand, the down counter 108 counts up the clock signal from the clock generator 107, and finally, a logic "1" signal is generated from the borrow-out terminal of the down counter 108, to reset the flip-flop 109, so that the drive circuit 110 stops the activation of the fuel injection valve 7, whereby an amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q from the airflow meter 3 and the coolant temperature data THW from the coolant sensor 9 are fetched by an A/D conversion routine(s) executed at predetermined intervals, and then stored in the RAM 105; i.e., the data Q and THW in RAM 105 are renewed at predetermined intervals.

Figure 2:
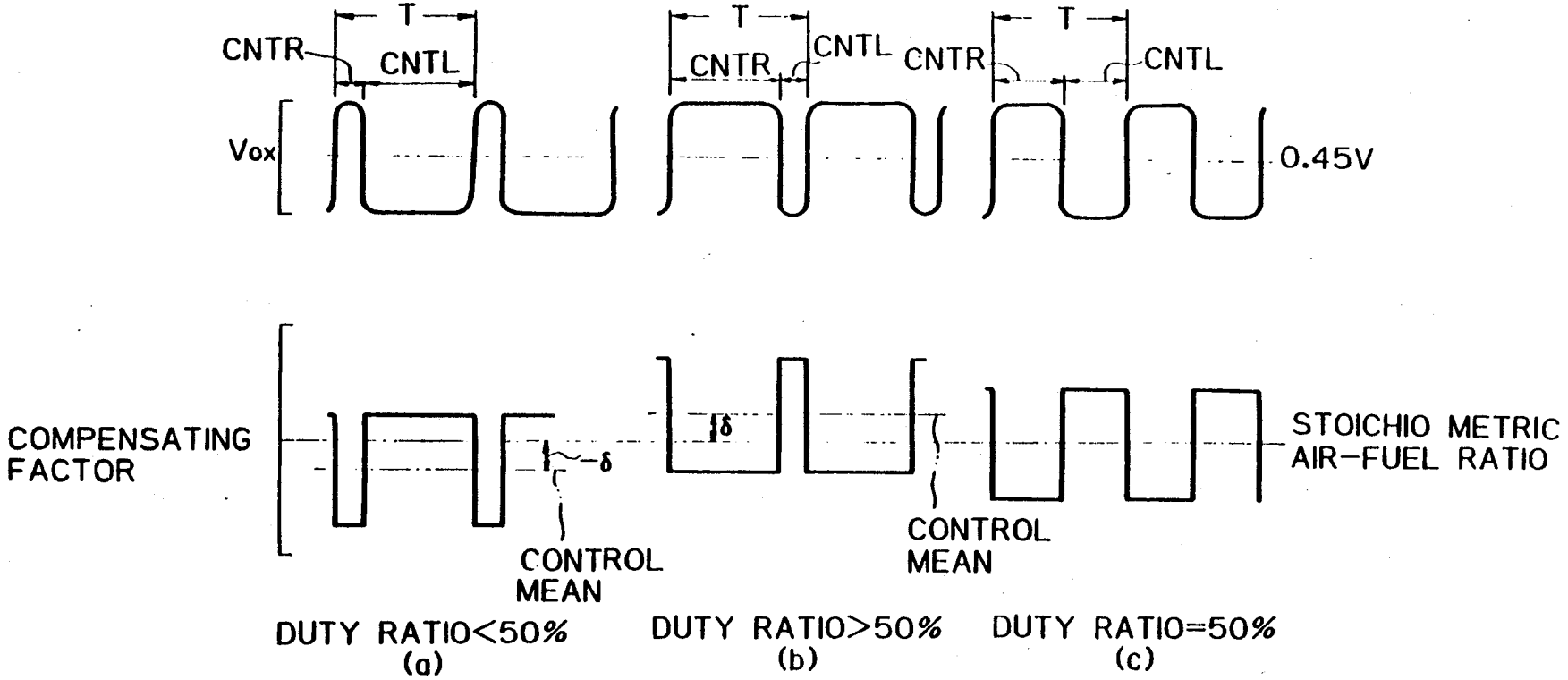
FIG. 2 is a graph showing the relationship between the output signal of the air-fuel ratio sensor and the coarse-adjusting term.

FIG. 2 is a graph showing the relationship between the output signal of the air-fuel ratio sensor and the coarse-adjusting term, wherein the abscissa shows time, and the ordinate shows the output of the air-fuel ratio sensor and the compensating factor for the air-fuel ratio control.

As shown in FIG. 2, if the gradual change by the coarse-adjusting term is inhibited as the inverting interval of the output of the air-fuel ratio sensor becomes shorter than the predetermined interval, a duty ratio, i.e., the ratio of period for which a rich state CNTR is maintained to the inverting period T, is converged far from 50% when the mean value of the compensating factor is not the stoichiometric air-fuel ratio.

Note, as shown in (a), when the mean value of the compensating factor deviates $-\delta$ from the stoichiometric line, the duty ratio is smaller than 50%. On the other hand, when the mean value deviates $+\delta$ from the stoichiometric line, the duty ratio is larger than 50%.

As long as the $O_2$ storage effect of the catalyst converter is normal, it is better to inhibit the gradual changing by the coarse-adjusting term even when the duty ratio is far from 50%, because the optimum mean value of the compensating factor is deviated from the value corresponding to the stoichiometric ratio, but if the performance of the catalyst converter is weakened, the mean value of the compensating factor must be maintained at the value corresponding to the stoichiometric ratio.

In accordance with the present invention, if the performance of the catalyst converter is weakened, the coarse-adjusting term is operated until the duty ratio approaches about 50%.

Figure 3:
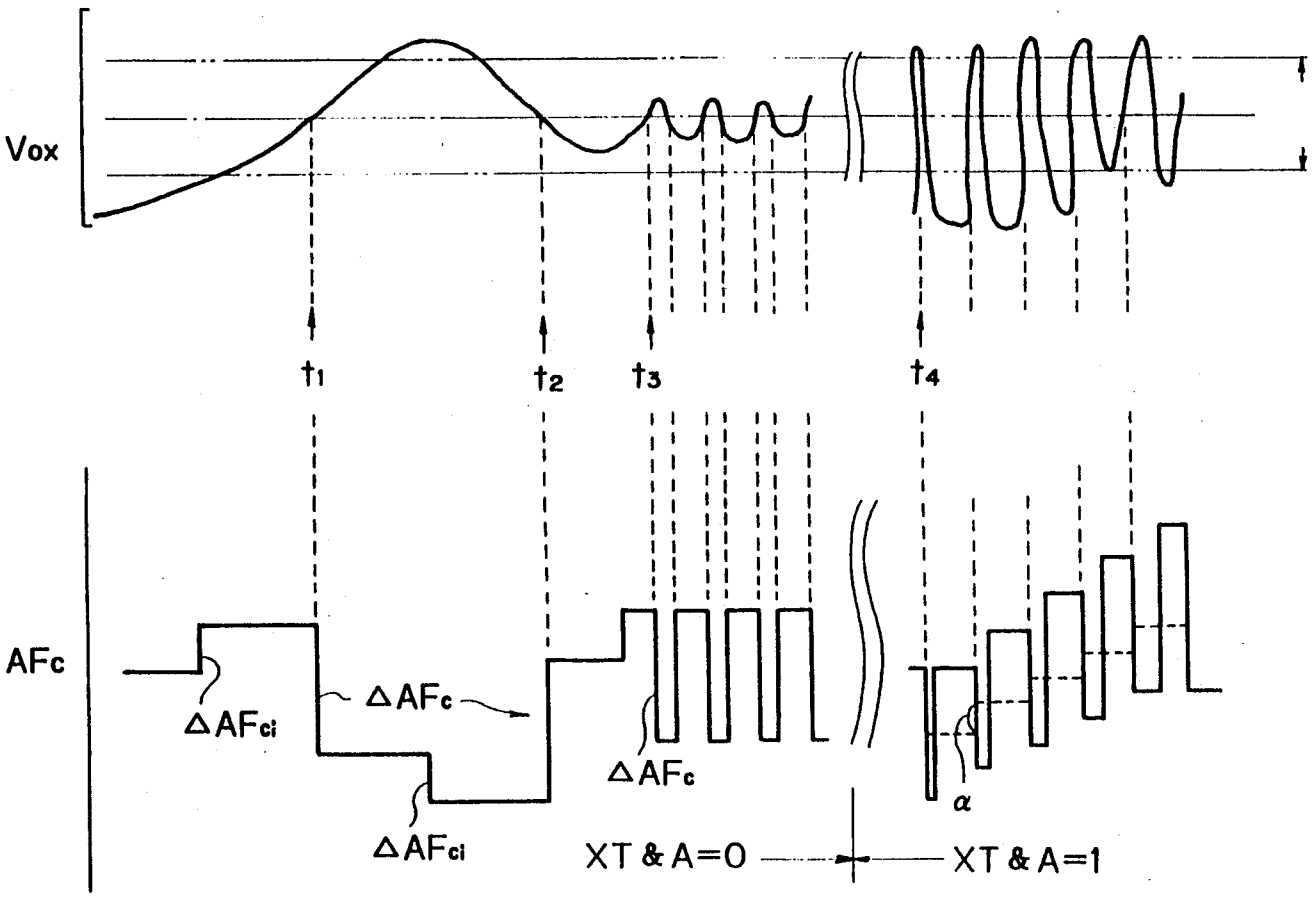
FIG. 3 is a timing diagram for explaining the control operation of the present invention.

FIG. 3 is a timing diagram for explaining the control operation of the present invention, wherein the abscissa shows time and the ordinate shows the outputs of the air-fuel ratio sensor and the coarse-adjusting term.

Each control routine will be further explained with reference to FIG. 3.

Figure 4B:
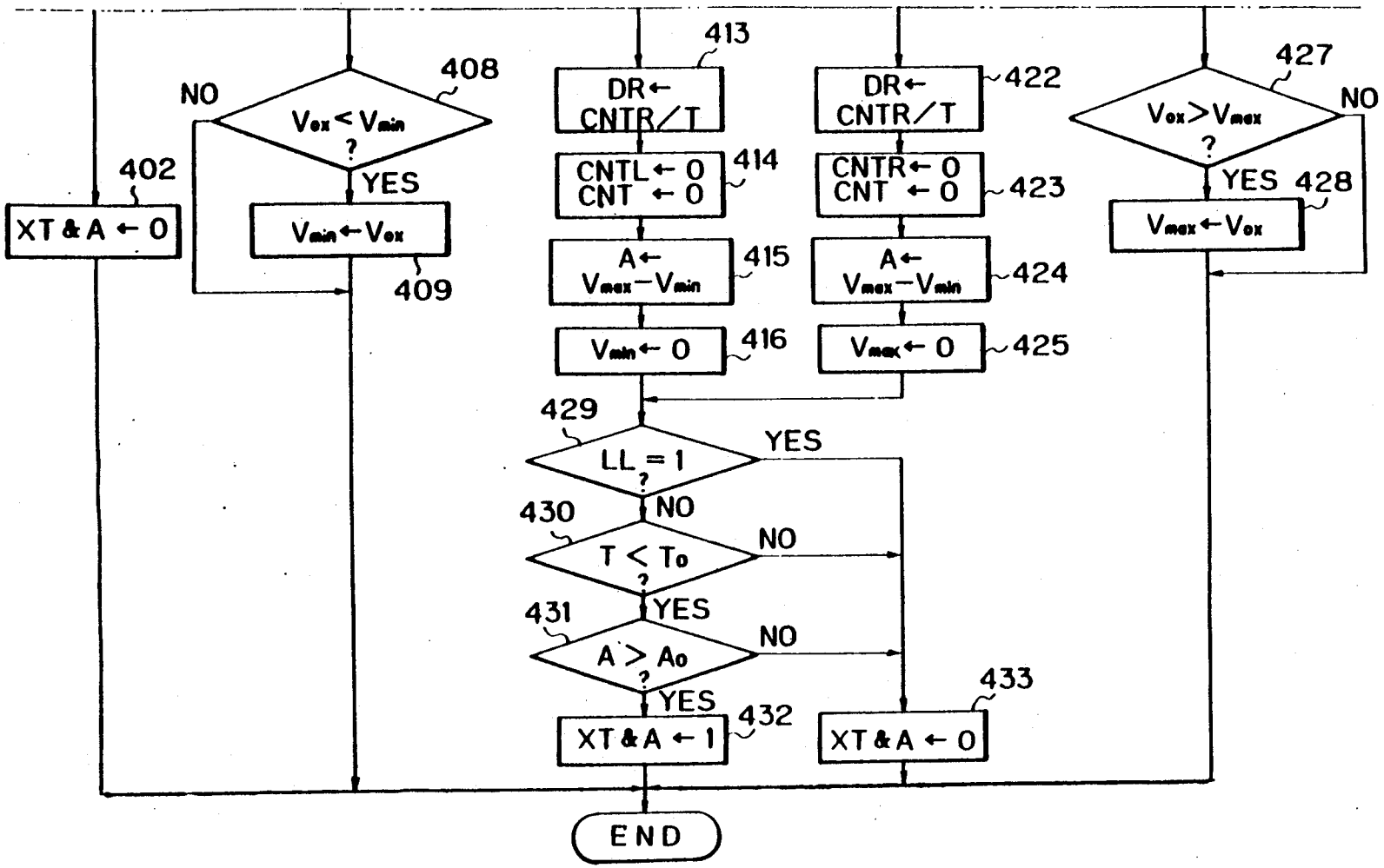
FIGS. 4*a* & *b*, 5, 6, 7, 8 and 9 are flow charts showing the operation of the control circuit of FIG. 1.

FIG. 4 is a routine for calculating the coarse-adjusting term AFc, inverting interval T, and the duty ratio, and is executed at predetermined intervals, such as 64 ms.

At step 401, it is determined whether or not the flag XFB is "1", which means the conditions for the feedback control are established.

For example, the feedback control is inhibited under the following conditions.

i) the engine is in a fuel cut-off state;

ii) the engine is in a state of waiting for a predetermined interval after a fuel cut-off condition has been released;

iii) the engine is in a fuel increase condition, to prevent an overheating of the catalyst converter;

iv) the engine is in a power increase condition.

In the above-mentioned states, when the flag XFB is "0", the control proceeds to step 402 where the flag XT&A is cleared, and this routine is completed.

If the conditions for the feedback control are satisfied, the control proceeds to step 403, where an A/D conversion is performed upon the output voltage Vox of the air-fuel ratio sensor 14, and the A/D converted value thereof is then fetched from the A/D converter 101. Then at step 404, the voltage Vox is compared with the reference voltage Vr such as 4.5 V, to thereby determine whether the current air-fuel ratio detected by the air-fuel ratio sensor 14 is on the rich side or the lean side with respect to the stoichiometric air-fuel ratio.

If Vox is smaller than Vr, which means that the current air-fuel ratio is lean, the control proceeds to step 405 and "0" is set to the air-fuel ratio flag XOX. Then, at step 406, it is determined whether or not a previous air-fuel ratio flag XOXO is "1" (rich), i.e., the air-fuel ratio flag XOX is inverted. When the previous air-fuel ratio XOXO is "0", which means that the rich state is maintained, the control proceeds to step 407.

In step 407, the counter CNTL, which designates the period for which the lean state is maintained, is incremented. Then, at step 408, it is determined whether or not the output voltage Vox of the air-fuel ratio sensor is larger than Vmin, where the minimum output voltage is stored. If Vox is smaller than Vmin, the control proceeds to step 409, which brings Vmin to Vox, and the routine is completed.

If the lean state is maintained, CNTL is incremented at every execution thereof, and the minimum value of the output voltage of the air-fuel ratio sensor is stored in Vmin.

Figure 5:
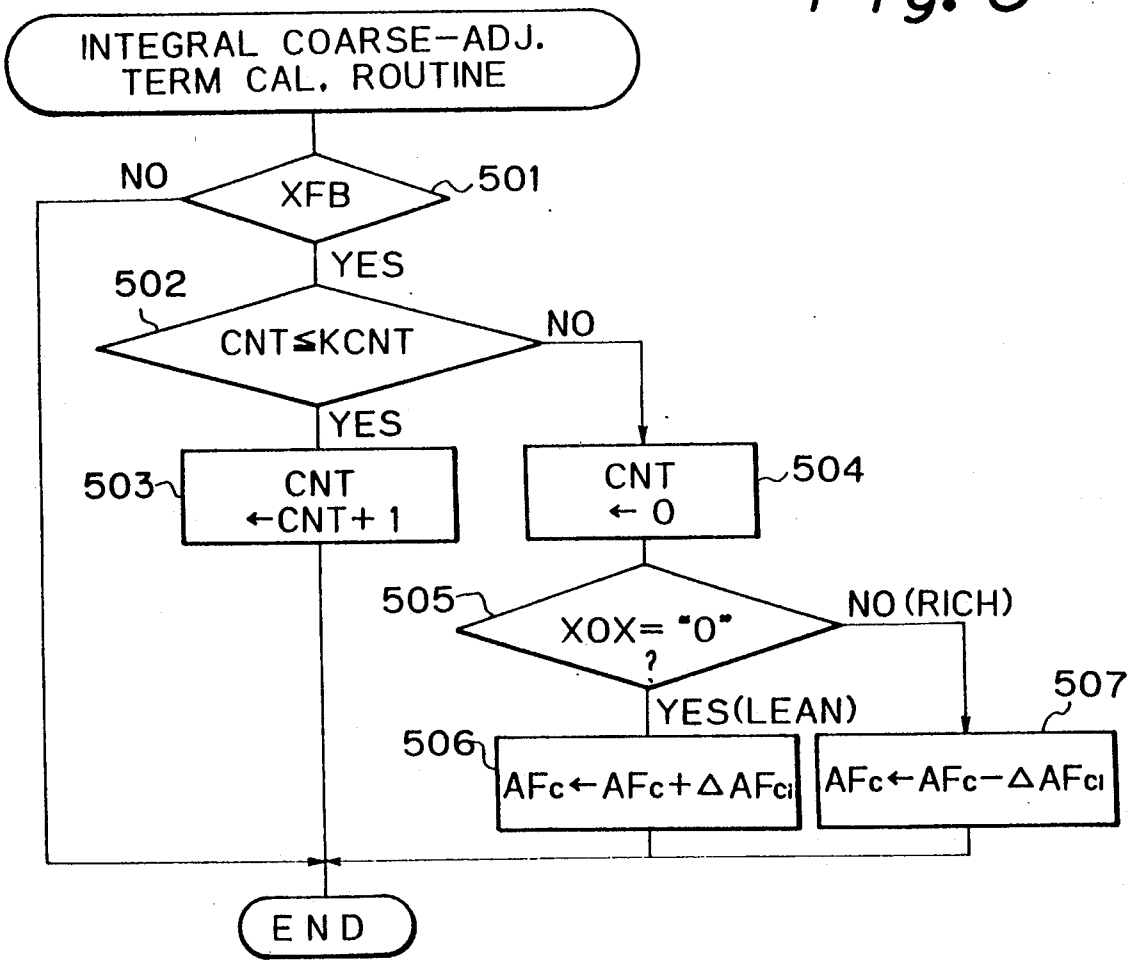

Before, $t_1$ in FIG. 3, the compensating factor is increased by the gradual change of the coarse-adjusting term calculated by the routine shown in FIG. 5.

As a result of this operation, if the current air-fuel ratio is inverted from the lean side to the rich side at $t_1$ in FIG. 3, the output voltage of the air-fuel ratio sensor Vox becomes larger than Vr, and the control then proceeds to step 417 and "1" is set to the flag XOX.

At step 418, it is determined whether or not a previous air-fuel flag XOXO is "0" (lean), i.e., the air-fuel ratio flag is inverted. As a result, only when the air-fuel ratio flag is inverted, does the control proceeds to step 419, which sets "1" in the flag XOXO. Then at step 420, the coarse-adjusting term AFc is greatly reduced by Δ AFcs as shown at $t_1$ in FIG. 3.

Then at step 421, the inverting period T is calculated by the following equation.

$$T = CNTL + CNTR \quad (1)$$

At step 422, the duty ratio DR is calculated by the following equation.

$$DR = CNTR/T \quad (2)$$

Then the control proceeds to step 423, which clears CNTR and CNT, and at step 424, the amplitude of the output of the air-fuel ratio sensor A is calculated by the following equation.

$$A = Vmax - Vmin \quad (3)$$

At step 425, Vmax is cleared and the control proceeds to step 429.

At step 429, it is determined whether or not the flag LL is "1". If the flag LL is "1", which means that the engine is in an idling state, the control proceeds to step 433, at which "0" is set to the flag XT&A, and the routine is completed.

If LL is "0", which means that the engine is in normal operation, the control proceeds to step 430, which determines whether or not the inverting period T is smaller than the predetermined period $T_0$. If T is larger than $T_0$, the control proceeds to step 433. On the other hand, if T is smaller than $T_0$, the control proceeds to step 431, which determines whether or not the amplitude A is larger than the predetermined value $A_0$.

If A is smaller than $A_0$, the control proceeds to step 433. On the other hand, if A is larger than $A_0$, the control proceeds to step 432, and "1" is set to the flag XT&A.

The flag XT&A designates whether or not the catalyst converter is deteriorated, and "1" at XT&A means the catalyst converter has deteriorated. In the present invention, when the inverting period T is smaller than the predetermined period $T_0$ and the amplitude of the output voltage of the air-fuel ratio sensor is larger than the predetermined amplitude, the catalyst converter is considered to have deteriorated.

When the rich state continues in spite of the great reduction of the air-fuel compensating factor, the control proceeds to step 426. At step 426, the counter CNTR which designates the period for which the rich state is maintained, is incremented. Then at next step 427, Vox is compared with Vmax, which stores the previous maximum value of the output voltage of the air-fuel ratio sensor. If Vox is larger than Vmax, step 428 makes Vmax to Vox.

Figure 9:
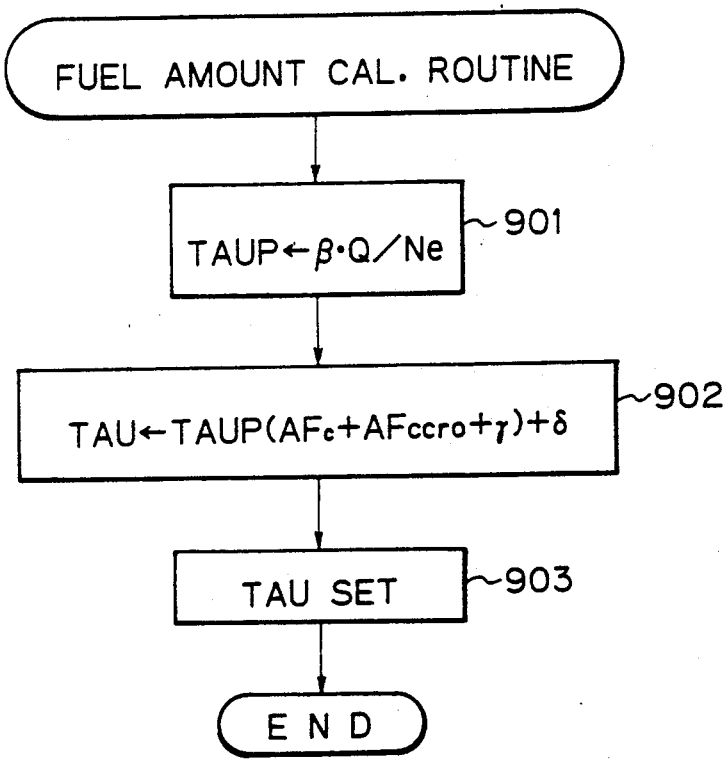

If the rich state is maintained, as shown from $t_1$ to $t_2$ in FIG. 9, the compensating factor is gradually decreased by the coarse-adjusting term calculated by the routine shown in FIG. 5.

As a result, the current air-fuel ratio is again inverted from the rich state to the lean state at $t_2$ in FIG. 3, and the control proceeds to step 405, which clears XOX.

At step 406, it is determined whether or not the previous air-fuel ratio flag XOXO is "1". When the current air-fuel ratio is inverted from the rich state to the lean state, the control proceeds to step 410, which clears XOXO.

Then, at step 411, the coarse-adjusting term is greatly increased by Δ AFcs, as shown at $t_2$ in FIG. 3. The inverting period and the duty ratio are calculated at step 413 and step 414 respectively. Further, the counter CNTL and CNT is cleared at step 414, the amplitude A is calculated at step 415, and the variable Vmin is cleared at step 416. Then the control proceeds to step 429.

If the lean state is maintained, the control proceeds to step 407; the following process has been explained.

FIG. 5 is a routine for calculating the gradual changing term in the coarse-adjusting term, executed at predetermined intervals, such as 64 ms.

At step 501, it is determined whether or not the flag XFB is "1", as in step 401. If XFB is "0", this routine is immediately completed. On the other hand, if XFB is "1", the control proceeds to step 502, which determines whether or not the counter CNT is equal to the predetermined value KCNT.

If CNT is smaller than KCNT, the control proceeds to step 503, which increments CNT, and this routine is completed.

When the same air-fuel ratio is maintained during the predetermined execution times, and CNT reaches KCNT, the control proceeds to step 504, which clears CNT. Then, at step 505, it is determined whether or not the air-fuel ratio flag XOX is "0".

If XOX is "0", which means that the lean state is maintained, the control proceeds to step 506, which increases the coarse-adjusting term AFc by Δ AFci.

That is, the coarse-adjusting term AFc is increased by Δ AFci every time CNT reaches KCNT.

On the other hand if XOX is "1", which means the rich state is maintained, the control proceeds to step 507, which decreases the coarse-adjusting term AFc by Δ AFci. That is, the coarse-adjusting term AFc is decreased by Δ AFci every time CNT reaches KCNT.

If the inverting period of the output of the air-fuel ratio sensor becomes shorter, the counter CNT is frequently reset at step 414 or 423, and CNT is always smaller than KCNT. As a result, the control proceeds to 503 at every execution thereof, and the gradual change in the coarse-adjusting term is inhibited, and only great increase/decrease functions, as shown after $t_3$ in FIG. 3.

If the $O_2$ storage effect of the catalyst converter is reduced, however, there is no guarantee that the mean value of the grate changing term corresponds to the correct stoichiometric air-fuel ratio.

To solve the above problem, the duty ratio is controlled until it reaches 50%, when the $O_2$ storage effect of the catalyst converter is reduced.

Figure 6:
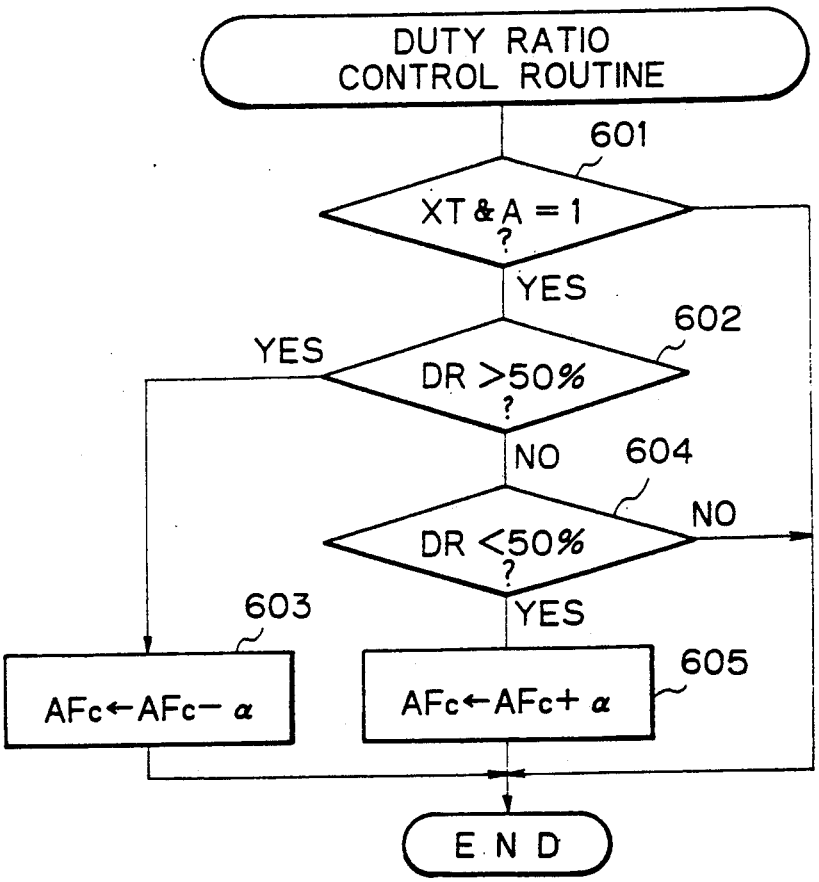

FIG. 6 is a routine for controlling the duty ratio, and is executed at predetermined intervals, such as 64 ms.

At step 601, it is determined whether or not the flag XT&A is "1", which means that the $O_2$ storage effect of the catalyst converter is reduced.

If XT&A is "0", this routine is immediately completed. On the other hand, if XT&A is "1", the control proceeds to step 602, which determines whether or not the duty ratio DR is smaller than 50%.

If DR is smaller than 50%, the control proceeds to step 603, which decreases the coarse-adjusting term by α, as shown at $t_4$ in FIG. 3.

If DR is equal to 50%, the control is ended and the coarse-adjusting term is not renewed.

If DR is larger than 50%, the control proceeds to step 605, which increases the coarse-adjusting term by α.

Since the gradual change in speed is generally set as a small value, to avoid overcompensation, a long time is required for the air-fuel ratio to be converged on the stoichiometric ratio when the deviation of the compensating factor from the value corresponding to the stoichiometric air-fuel ratio is large.

To solve the above problem, in the preferred embodiment, the $O_2$ storage term is used as the present inventors have already suggested (see Japanese Patent Application No. 1-297680 filed on Nov. 17, 1989 or Japanese Patent Application No. 2-22141 filed on Feb. 2, 1990).

Figure 7:
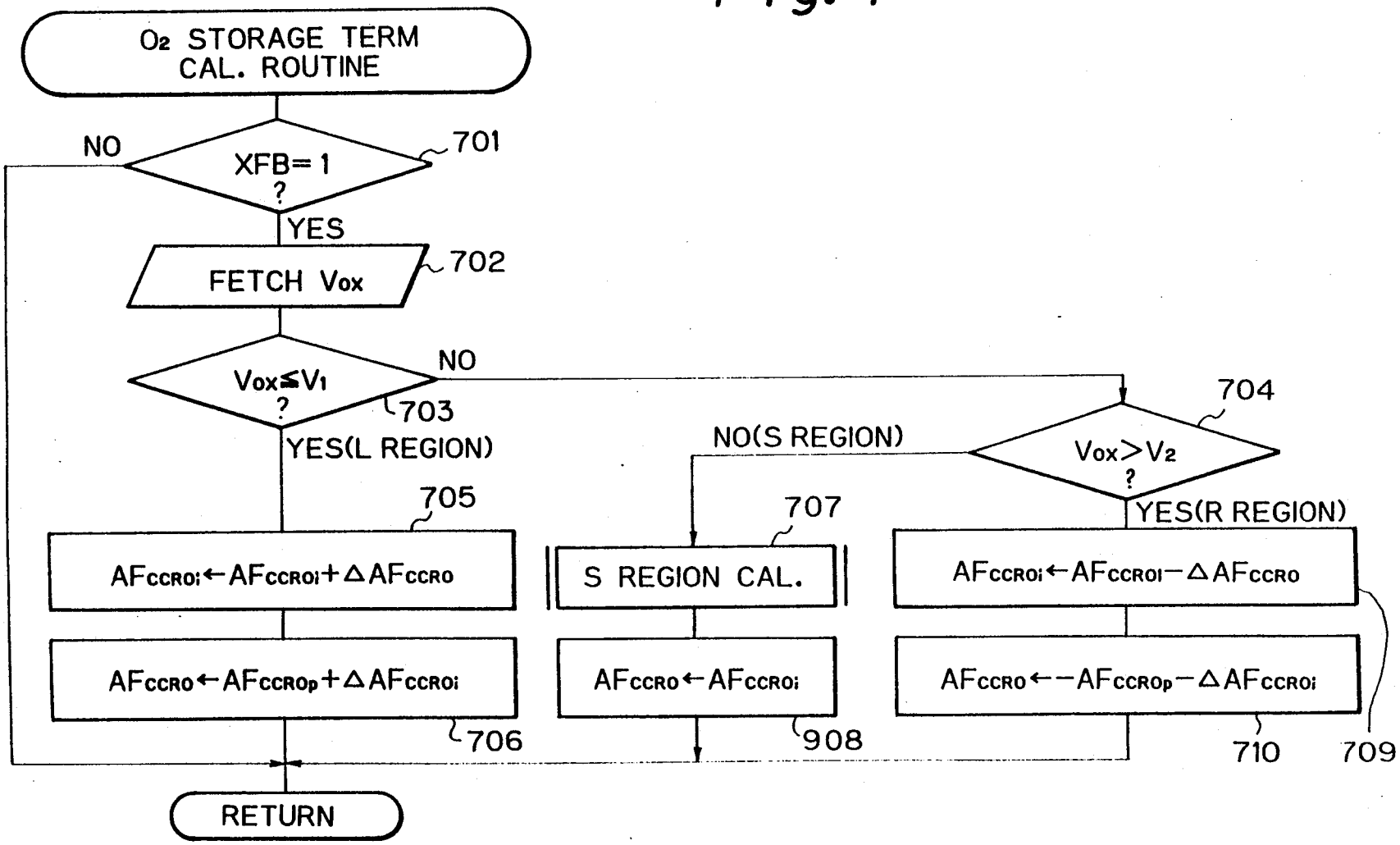
Figure 8:
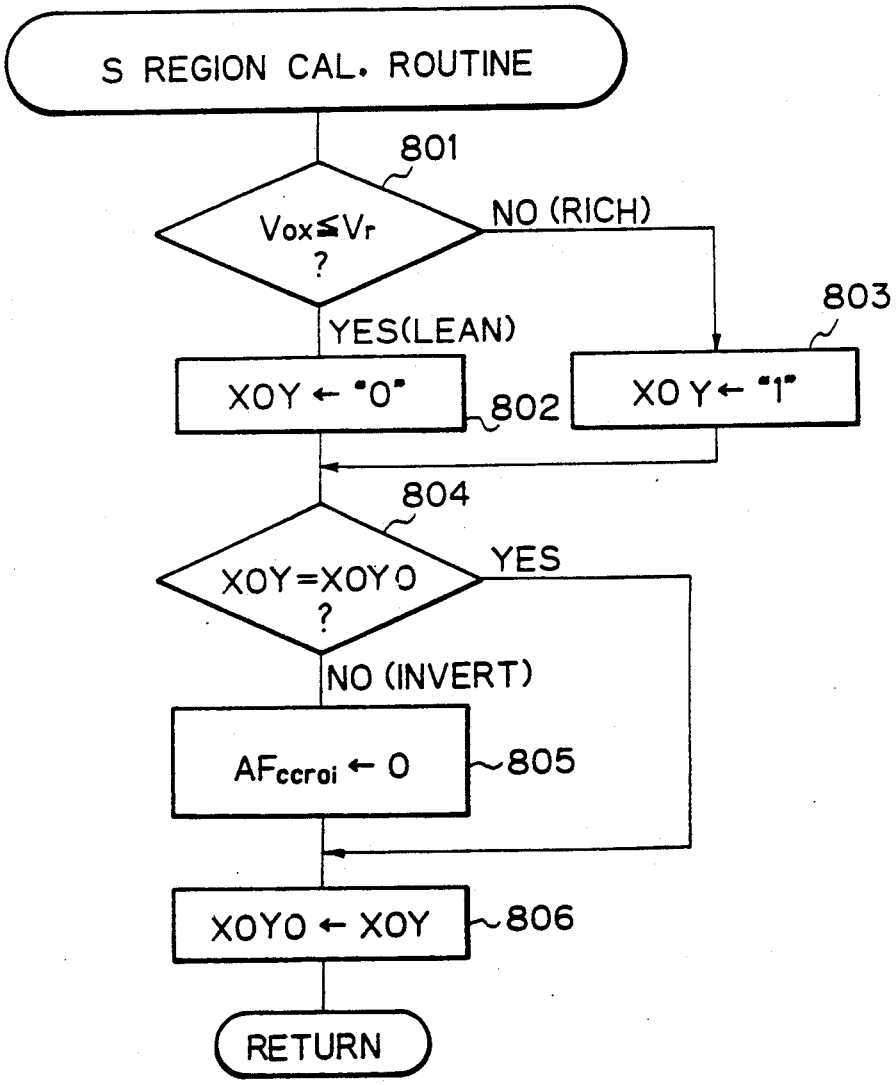

FIG. 7 and 8 is a routine for calculating the $O_2$ storage term, and is executed at predetermined intervals such as 64 ms.

At step 701, it is determined whether or not the flag XFB is "1". If XFB is "0", this routine is immediately completed. On the other hand, if XFB is "1", the control proceeds to step 702 and Vox is fetched through the A/D converter 101.

At step 703, it is determined whether or not the output voltage Vox of the air-fuel ratio sensor 14 is smaller than the first threshold value $V_1$. If Vox is larger than $V_1$, at step 704 it is determined whether or not Vox is larger than the second threshold value $V_2$. Note, a range of the output Vox of the air-fuel ratio sensor 14 is divided into three regions, as follows:

| | |
|---|---|
| "L" (lean) region: | 0 (Volt) ~ $V_1$ |
| "S" (stoichiometric) region: | $V_1$ ~ $V_2$ |

-continued

| | |
|---|---|
| "R" (rich) region: | $V_2$ ~ 1 (Volt) |

As a result, when Vox is smaller than $V_1$, which means that the current air-fuel ratio is in the "L" region, the control proceeds to step 705, which gradually increases the $O_2$ storage term AFccroi by $$AFccroi \leftarrow AFccroi + \Delta AFccro \text{ (definite)}$$

Then, at step 706, the $O_2$ storage term AFccro is calculated by $$AFccro \leftarrow AFccroi + AFccrop$$

Therefore, the $O_2$ storage term AFccro is remarkably increased by AFccrop, then gradually increased with gradual change in speed Δ AFccro.

When Vox is higher than the first threshold value $V_1$, as the result of the increase of the $O_2$ storage term AFccro, the control proceeds to step 704, which determines whether or not Vox is larger than the second threshold value $V_2$.

If Vox is smaller than $V_2$, which means that the current air-fuel ratio is in the "S" region, the control proceeds to step 707, as described hereunder, and then proceeds to step 708, which makes AFccro to AFccroi.

If the current air-fuel ratio become higher than the second threshold value $V_2$, the control proceeds to step 709, which gradually decreases and integral air-fuel ratio storage amount AFccroi by $$AFccroi \leftarrow AFccroi - \Delta AFccro \text{ (definite)}$$

The, at step 710, the $O_2$ storage term AFccro is calculated by $$AFccro \leftarrow AFccroi - AFccrop$$

Therefore, the $O_2$ storage term AFccro is greatly decreased by AFccrop, then gradually decreased with the gradual change in speed AFccroi.

FIG. 8 is a routine for processing of step 707, and is executed in accordance with the routine shown FIG. 7.

At step 801, it is determined whether or not Vox is smaller than Vr. If Vox is smaller than Vr, the control proceeds to step 802, which sets "0" in XOY, and then proceeds to step 804. ON the other hand, if Vox is larger than Vr, the control proceeds to step 803, which sets "1" in XOY, and then proceeds to step 804.

At step 804, it is determined whether or not the flag XOY is equal to the flag XOYO. If XOY is equal to XOYO, which means that the air-fuel ratio is in the same state, the control proceeds to step 806. If XOY is not equal to XOYO, the control proceeds to step 805, which clears AFccri, and then proceeds to step 806. At step 806, XOYO is made to XOY, and this routine is completed.

FIG. 9 is a routine for calculating the fuel injection amount. At step 901, the basic fuel injection amount TAUP is calculated based on the intake air-flow Q measured by the air-flow meter 3 and the engine rotating speed Ne, determined by the output of the crank angle sensors 5 and 6, using following equation.

$$TAUP = \beta \cdot Q/Ne \quad (4)$$

where $\beta$ is constant.

At step 902, the fuel injection amount is calculated by the following equation.

$$TAU = TAUP \times (AFc + AFccro + \gamma) + \delta \quad (5)$$

where AFc = the coarse-adjusting term
AFccro = the $O_2$ storage term
$\gamma$, $\delta$ = constant At step 903, the fuel injection amount TAU is set to the counter 108, and the determined amount of fuel is injected from injector 7.

Note, a Karman vortex sensor, hardware type flow sensor, and the like can be used instead of the air-flow meter.

Although, in the above-mentioned embodiments, a fuel injection amount is calculated on the basis of the intake air amount and engine speed, it also can be calculated on the basis of the intake air pressure and engine speed, or the throttle opening and the engine speed.

We claim:

1. A method of controlling an air-fuel ratio in an internal combustion engine having a three-way catalyst converter for removing pollutants in the exhaust gas of said engine, an air-fuel ratio sensor, disposed downstream of said three-way catalyst converter, for detecting a specific component in the exhaust gas, comprising the steps of:

greatly changing a coarse-adjusting term when the output of said air-fuel ratio sensor is inverted from the rich state to the lean state and vice versa, and gradually changing said course-adjusting term when the output of said air-fuel ratio sensor remains in the same state;

determining whether or not said catalyst converter is deteriorated;

calculating a duty ratio of a period where the output of said air-fuel ratio sensor is in the rich state to a period where the output of said air-fuel ratio sensor is in the lean state;

determining whether or not said duty ratio is equal to a first predetermined value;

inhibiting said gradual changing of said coarse-adjusting term when said catalyst converter is deteriorated, and said duty ratio is equal to said first predetermined value; and adjusting an actual air-fuel ratio in accordance with said coarse-adjusting term.

2. A method as set forth in claim 1, further comprising the steps of:

determining whether or not said inverting cycle is shorter than a second predetermined value;

inhibiting said gradual change of said coarse-adjusting term when said catalyst converter is not deteriorated, and said inverting cycle is shorter than a second predetermined value.

3. A method as set forth in claim 1, further comprising a step of gradually changing an $O_2$ storage term;

said actual air-fuel ratio adjusting step adjusting said actual air-fuel ratio in accordance with said $O_2$ storage term.

4. A method as set forth in claim 3, further comprising the steps of:

determining whether or not said output of the air-fuel ratio sensor is inverted from the rich state to the lean state;

greatly increasing said $O_2$ storage term when said output of the air-fuel ratio sensor is inverted from the rich state to the lean state;

determining whether or not said output of the air-fuel ratio sensor is inverted from the lean state to the rich state;

greatly decreasing said $O_2$ storage term when said output of the air-fuel ratio sensor is inverted from the lean state to the rich state.

5. A method as set forth in claim 4, further comprising the steps of:

determining whether or not the output of said air-fuel ratio sensor is in semi-stoichiometric air-fuel ratio region between a first threshold value which is smaller than a value corresponding to the stoichiometric air-fuel ratio and a second threshold value which is larger than a value corresponding to the stoichiometric air-fuel ratio;

clearing said $O_2$ storage term when said output of the air-fuel ratio sensor is in said semi-stoichiometric region.

6. A method as set forth in claim 1, further comprising an $O_2$ storage effect determining step performed by:

determining whether or not an inverting cycle is shorter than a second predetermined value.

7. A method as set forth in claim 1, further comprising an $O_2$ storage effect determining step performed by:

determining whether or not an amplitude of said output of said air-fuel ratio sensor is larger than a second predetermined value.

8. A method as set forth in claim 1, wherein in order to inhibit said gradual changing of said coarse-adjusting term said first predetermined value is 50%.

9. An apparatus for controlling an air-fuel ratio in an internal combustion engine having a three-way catalyst converter for removing pollutants in the exhaust gas of said engine, an air-fuel ratio sensor, disposed downstream of said three-way catalyst converter, for detecting a specific component in the exhaust gas, comprising of:

means for gradually changing a coarse-adjusting term when the output of said air-fuel ratio sensor is inverted from the rich state to the lean state and vice versa, and gradually changing said coarse-adjusting term when the output of said air-fuel ratio sensor remains in the same state;

means for determining whether or not said catalyst converter is deteriorated;

means for calculating a duty ratio of a period where the output of said air-fuel ratio sensor is in the rich state to a period where the output of said air-fuel ratio sensor is the lean state;

means for determining whether or not said duty ratio is equal to a first predetermined value;

means for inhibiting said gradual changing of said coarse-adjusting term when said $O_2$ storage effect of said catalyst converter is reduced, and said duty ratio is equal to said first predetermined value; and means for adjusting an actual air-fuel ratio in accordance with said coarse-adjusting term.

10. An apparatus as set forth in claim 9, further comprising of:

means for determining whether or not said inverting cycle is shorter than a second predetermined value;

means for inhibiting said gradual change of said coarse-adjusting term when said catalyst converter is not deteriorated, and said inverting cycle is shorter than a second predetermined value.

11. An apparatus as set forth in claim 9, further comprising means for gradually changing an $O_2$ storage term;

means for adjusting said actual air-fuel ratio in accordance with said $O_2$ storage term.

12. An apparatus as set forth in claim 11, further comprising:

means for determining whether or not said output of the air-fuel ratio sensor is inverted from the rich state to the lean state;

means for greatly increasing said $O_2$ storage term when said output of the air-fuel ratio sensor is inverted from the rich state to the lean state;

means for determining whether or not said output of the air-fuel ratio sensor is inverted from the lean state to the rich state;

means for greatly decreasing said $O_2$ storage term when said output of the air-fuel ratio sensor is inverted from the lean state to the rich state.

13. An apparatus as set forth in claim 12, further comprising of:

means for determining whether or not output of said air-fuel ratio sensor is in a semi-stoichiometric air-fuel ratio region between a first threshold value which is smaller than a value corresponding to the stoichiometric air-fuel ratio and a second threshold value which is larger than a value corresponding to the stoichiometric air-fuel ratio;

means for clearing said $O_2$ storage term when said output of the air-fuel ratio sensor is in said semi-stoichiometric region.

14. An apparatus as set forth in claim 9, wherein said $O_2$ storage effect determining step comprises:

means for determining whether or not said inverting cycle is shorter than a second predetermined value.

15. An apparatus as set forth in claim 9, wherein said $O_2$ storage effect determining step comprises:

means for determining whether or not an amplitude of said output of said air-fuel ratio sensor is larger than a second predetermined value.

16. An apparatus as set forth in claim 9, wherein in order to inhibit gradual changing of coarse-adjusting term said first predetermined value is 50%.

* * * * *